US007780271B2

(12) United States Patent
North et al.

(10) Patent No.: US 7,780,271 B2
(45) Date of Patent: Aug. 24, 2010

(54) PRINTHEAD WITH HEATERS OFFSET FROM NOZZLES

(75) Inventors: Angus John North, Balmain (AU); Kia Silverbrook, Balmain (AU); Brian Robert Brown, Balmain (AU); Samuel James Myers, Balmain (AU); Jennifer Mia Fishburn, Balmain (AU); Samuel George Mallinson, Balmain (AU); Paul Justin Reichl, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 566 days.

(21) Appl. No.: 11/764,808

(22) Filed: Aug. 12, 2007

(65) Prior Publication Data

US 2009/0040276 A1 Feb. 12, 2009

(51) Int. Cl.
*B41J 2/05* (2006.01)

(52) U.S. Cl. ..... 347/65; 347/61

(58) Field of Classification Search ..... 347/65, 347/61, 62–63, 50, 54–59, 44, 20, 9, 5, 14
See application file for complete search history.

(56) References Cited

U.S. PATENT DOCUMENTS

| | | | | |
|---|---|---|---|---|
| 6,761,435 | B1 | 7/2004 | Powers | |
| 7,018,017 | B2 * | 3/2006 | Song et al. | 347/56 |
| 7,163,278 | B2 * | 1/2007 | Lee et al. | 347/56 |
| 7,207,662 | B2 * | 4/2007 | Shin et al. | 347/63 |
| 2005/0041071 | A1 | 2/2005 | Parish et al. | |

* cited by examiner

*Primary Examiner*—K. Feggins

(57) ABSTRACT

A thermal inkjet printhead of the roof shooter type that slightly offsets the nozzle aperture centroid from the heater element centroid to correct drop trajectory misdirection caused by vapor bubble asymmetries.

16 Claims, 11 Drawing Sheets

PRINTHEAD WITH HEATERS OFFSET FROM NOZZLES

FIELD OF THE INVENTION

The present invention relates to the field of inkjet printers. In particular, the invention concerns printheads with heater elements that vaporize ink to eject an ink droplet from the nozzle.

CROSS REFERENCE TO RELATED APPLICATIONS

The following patents or patent applications filed by the applicant or assignee of the present invention are hereby incorporated by cross-reference.

| | | | | | | |
|---|---|---|---|---|---|---|
| 6,405,055 | 6,628,430 | 7,136,186 | 10/920,372 | 7,145,689 | 7,130,075 | 7,081,974 |
| 7,177,055 | 7,209,257 | 7,161,715 | 7,154,632 | 7,158,258 | 7,148,993 | 7,075,684 |
| 11/635,526 | 11/650545 | 11/653241 | 11/653,240 | 11758,648 | 10/503,924 | 7,108,437 |
| 6,915,140 | 6,999,206 | 7,136,198 | 7,092,130 | 09/517,539 | 6,566,858 | 6,331,946 |
| 6,246,970 | 6,442,525 | 09/517384 | 09/505,951 | 6,374,354 | 09/517,608 | 6,816,968 |
| 6,757,832 | 6,334,190 | 6,745,331 | 09/517,541 | 10/203,559 | 7,197,642 | 7,093,139 |
| 10/636,263 | 10/636,283 | 10/866,608 | 7,210,038 | 10/902,833 | 10/940,653 | 10/942,858 |
| 11/706,329 | 11757,385 | 11758,642 | 7,170,652 | 6,967,750 | 6,995,876 | 7,099,051 |
| 11/107,942 | 71937,34 | 11/209,711 | 11/599,336 | 7,095,533 | 6,914,686 | 7,161,709 |
| 7,099,033 | 11/003,786 | 11/003,616 | 11/003,418 | 11/003,334 | 11/003,600 | 11/003,404 |
| 11/003,419 | 11/003,700 | 11/003,601 | 11/003,618 | 11/003,615 | 11/003,337 | 11/003,698 |
| 11/003,420 | 6,984,017 | 11/003,699 | 11/071,473 | 11748,482 | 11/003,463 | 11/003,701 |
| 11/003,683 | 11/003,614 | 11/003,702 | 11/003,684 | 11/003,619 | 11/003,617 | 11/293,800 |
| 11/293,802 | 11/293,801 | 11/293,808 | 11/293,809 | 11/482,975 | 11/482,970 | 11/482,968 |
| 11/482,972 | 11/482,971 | 11/482,969 | 11/097,266 | 11/097,267 | 11/685,084 | 11/685,086 |
| 11/685,090 | 11/740,925 | 11/763,444 | 11/763,443 | 11/518,238 | 11/518,280 | 11/518,244 |
| 11/518,243 | 11/518,242 | 11/084,237 | 11/084,240 | 11/084,238 | 11/357,296 | 11/357,298 |
| 11/357,297 | 11/246,676 | 11/246,677 | 11/246,678 | 11/246,679 | 11/246,680 | 11/246,681 |
| 11/246,714 | 11/246,713 | 11/246,689 | 11/246,671 | 11/246,670 | 11/246,669 | 11/246,704 |
| 11/246,710 | 11/246,688 | 11/246,716 | 11/246,715 | 11/246,707 | 11/246,706 | 11/246,705 |
| 11/246,708 | 11/246,693 | 11/246,692 | 11/246,696 | 11/246,695 | 11/246,694 | 11/482,958 |
| 11/482,955 | 11/482,962 | 11/482,963 | 11/482,956 | 11/482,954 | 11/482,974 | 11/482,957 |
| 11/482,987 | 11/482,959 | 11/482,960 | 11/482,961 | 11/482,964 | 11/482,965 | 11/482,976 |
| 11/482,973 | 11/495,815 | 11/495,816 | 11/495,817 | 6,227,652 | 6,213,588 | 6,213,589 |
| 6,231,163 | 6,247,795 | 6,394,581 | 6,244,691 | 6,257,704 | 6,416,168 | 6,220,694 |
| 6,257,705 | 6,247,794 | 6,234,610 | 6,247,793 | 6,264,306 | 6,241,342 | 6,247,792 |
| 6,264,307 | 6,254,220 | 6,234,611 | 6,302,528 | 6,283,582 | 6,239,821 | 6,338,547 |
| 6,247,796 | 6,557,977 | 6,390,603 | 6,362,843 | 6,293,653 | 6,312,107 | 6,227,653 |
| 6,234,609 | 6,238,040 | 6,188,415 | 6,227,654 | 6,209,989 | 6,247,791 | 6,336,710 |
| 6,217,153 | 6,416,167 | 6,243,113 | 6,283,581 | 6,247,790 | 6,260,953 | 6,267,469 |
| 6,588,882 | 6,742,873 | 6,918,655 | 6,547,371 | 6,938,989 | 6,598,964 | 6,923,526 |
| 6,273,544 | 6,309,048 | 6,420,196 | 6,443,558 | 6,439,689 | 6,378,989 | 6,848,181 |
| 6,634,735 | 6,299,289 | 6,299,290 | 6,425,654 | 6,902,255 | 6,623,101 | 6,406,129 |
| 6,505,916 | 6,457,809 | 6,550,895 | 6,457,812 | 7,152,962 | 6,428,133 | 7,216,956 |
| 7,080,895 | 11/144,844 | 7,182,437 | 11/599,341 | 11/635,533 | 11/607,976 | 11/607,975 |
| 11/607,999 | 11/607,980 | 11/607,979 | 11/607,978 | 11/735,961 | 11/685,074 | 11/696,126 |
| 11/696,144 | 11/696,650 | 11/763,446 | 10/407,212 | 10/407,207 | 10/683,064 | 10/683,041 |
| 11/482,980 | 11/563,684 | 11/482,967 | 11/482,966 | 11/482,988 | 11/482,989 | 11/293,832 |
| 11/293,838 | 11/293,825 | 11/293,841 | 11/293,799 | 11/293,796 | 11/293,797 | 11/293,798 |
| 11/124,158 | 11/124,196 | 11/124,199 | 11/124,162 | 11/124,202 | 11/124,197 | 11/124,154 |
| 11/124,198 | 11/124,153 | 11/124,151 | 11/124,160 | 11/124,192 | 11/124,175 | 11/124,163 |
| 11/124,149 | 11/124,152 | 11/124,173 | 11/124,155 | 11/124,157 | 11/124,174 | 11/124,194 |
| 11/124,164 | 11/124,200 | 11/124,195 | 11/124,166 | 11/124,150 | 11/124,172 | 11/124,165 |
| 11/124,186 | 11/124,185 | 11/124,184 | 11/124,182 | 11/124,201 | 11/124,171 | 11/124,181 |
| 11/124,161 | 11/124,156 | 11/124,191 | 11/124,159 | 11/124,176 | 11/124,188 | 11/124,170 |
| 11/124,187 | 11/124,189 | 11/124,190 | 11/124,180 | 11/124,193 | 11/124,183 | 11/124,178 |
| 11/124,177 | 11/124,148 | 11/124,168 | 11/124,167 | 11/124,179 | 11/124,169 | 11/187,976 |
| 11/188,011 | 11/188,014 | 11/482,979 | 11/735,490 | 11/228,540 | 11/228,500 | 11/228,501 |
| 11/228,530 | 11/228,490 | 11/228,531 | 11/228,504 | 11/228,533 | 11/228,502 | 11/228,507 |
| 11/228,482 | 11/228,505 | 11/228,497 | 11/228,487 | 11/228,529 | 11/228,484 | 11/228,489 |
| 11/228,518 | 11/228,536 | 11/228,496 | 11/228,488 | 11/228,506 | 11/228,516 | 11/228,526 |
| 11/228,539 | 11/228,538 | 11/228,524 | 11/228,523 | 11/228,519 | 11/228,528 | 11/228,527 |
| 11/228,525 | 11/228,520 | 11/228,498 | 11/228,511 | 11/228,522 | 111/22,8515 | 11/228,537 |
| 11/228,534 | 11/228,491 | 11/228,499 | 11/228,509 | 11/228,492 | 11/228,493 | 11/228,510 |
| 11/228,508 | 11/228,512 | 11/228,514 | 11/228,494 | 11/228,495 | 11/228,486 | 11/228,481 |
| 11/228,477 | 11/228,485 | 11/228,483 | 11/228,521 | 11/228,517 | 11/228,532 | 11/228,513 |
| 11/228,503 | 11/228,480 | 11/228,535 | 11/228,478 | 11/228,479 | 6,087,638 | 6,340,222 |
| 6,041,600 | 6,299,300 | 6,067,797 | 6,286,935 | 6,044,646 | 6,382,769 | 10/868,866 |
| 6,787,051 | 6,938,990 | 11/242,916 | 11/242,917 | 11/144,799 | 11/198,235 | 7,152,972 |
| 11/592,996 | 6,746,105 | 11/763,440 | 11/763,442 | 11/246,687 | 11/246,718 | 11/246,685 |
| 11/246,686 | 11/246,703 | 11/246,691 | 11/246,711 | 11/246,690 | 11/246,712 | 11/246,717 |
| 11/246,709 | 11/246,700 | 11/246,701 | 11/246,702 | 11/246,668 | 11/246,697 | 11/246,698 |
| 11/246,699 | 11/246,675 | 11/246,674 | 11/246,667 | 7,156,508 | 7,159,9,72 | 7,083,271 |
| 7,165,834 | 7,080,894 | 7,201,469 | 7,090,336 | 7,156,489 | 10/760,233 | 10/760,246 |
| 7,083,257 | 10/760,243 | 10/760,201 | 7,219,980 | 10/760253 | 10/760,255 | 10/760,209 |
| 7,118,192 | 10/760,194 | 10/760,238 | 7,077,505 | 7,198,354 | 7,077,504 | 10/760,189 |
| 7,198,355 | 10/760,232 | 10/760,231 | 7,152,959 | 7,213,906 | 7,178,901 | 7,222,938 |

-continued

| | | | | | | |
|---|---|---|---|---|---|---|
| 7,108,353 | 7,104,629 | 11/446,227 | 11/454,904 | 11/472,345 | 11/474,273 | 11/478,594 |
| 11/474,279 | 11/482,939 | 11/482,950 | 11/499,709 | 11/592,984 | 11/601,668 | 11/603,824 |
| 11/601,756 | 11/601,672 | 11/650,546 | 11/653,253 | 11/706,328 | 11/706,299 | 11/706,965 |
| 11/737,080 | 11/737,041 | 11/246,684 | 11/246,672 | 11/246,673 | 11/246,683 | 11/246,682 |
| 10/728,804 | 7,128,400 | 7,108,355 | 6,991,322 | 10/728,790 | 7,118,197 | 10/728,970 |
| 10/728,784 | 10/728,783 | 7,077,493 | 6,962,402 | 10/728,803 | 7,147,308 | 10/728,779 |
| 7,118,198 | 7,168,790 | 7,172,270 | 10/773,199 | 6,830,318 | 7,195,342 | 7,175,261 |
| 10/773,183 | 7,108,356 | 7,118,202 | 10/773,186 | 7,134,744 | 10/773,185 | 7,134,743 |
| 7,182,439 | 7,210,768 | 10/773,187 | 7,134,745 | 7,156,484 | 7,118,201 | 7,111,926 |
| 10/773,184 | 7,018,021 | 11/060,751 | 11/060,805 | 11/188,017 | 7,128,402 | 11/298,774 |
| 11/329,157 | 11/490,041 | 11/501,767 | 11/499,736 | 11/505,935 | 11/506,172 | 11/505,846 |
| 11/505,857 | 11/505,856 | 11/524,908 | 11/524,938 | 11/524,900 | 11/524,912 | 11/592,999 |
| 11/592,995 | 11/603,825 | 11/649,773 | 11/650,549 | 11/653,237 | 11/706,378 | 11/706,962 |
| 11749,118 | 11/754,937 | 11749,120 | 11/744,885 | 11/097,308 | 11/097,309 | 11/097,335 |
| 11/097,299 | 11/097,310 | 11/097,213 | 11/210,687 | 11/097,212 | 7,147,306 | 11/545,509 |
| 11/482,953 | 11/482,977 | 11/544,778 | 11/544,779 | 11/066,161 | 11/066,160 | 11/066,159 |
| 11/066,158 | 11/066,165 | 10/727,181 | 10/727,162 | 10/727,163 | 10/727,245 | 7,121,639 |
| 7,165,824 | 7,152,942 | 10/727,157 | 7,181,572 | 7,096,137 | 10/727,257 | 10/727,238 |
| 7,188,282 | 10/727,159 | 10/727,180 | 10/727,179 | 10/727,192 | 10/727,274 | 10/727,164 |
| 10/727,161 | 10/727,198 | 10/727,158 | 10/754,536 | 10/754,938 | 10/727,227 | 10/727,160 |
| 10/934,720 | 7,171,323 | 11/272,491 | 11/474,278 | 11/488,853 | 11/488,841 | 11749,750 |
| 11749,749 | 10/296,522 | 6,795,215 | 7,070,098 | 7,154,638 | 6,805,419 | 6,859,289 |
| 6,977,751 | 6,398,332 | 6,394,573 | 6,622,923 | 6,747,760 | 6,921,144 | 10/884,881 |
| 7,092,112 | 7,192,106 | 11/039866 | 7,173,739 | 6,986,560 | 7,008,033 | 11/148,237 |
| 7,222,780 | 11/248,426 | 11/478599 | 11/499749 | 11/738,518 | 11/482,981 | 11/743,661 |
| 11/743,659 | 11/752,900 | 7,195,328 | 7,182,422 | 11/650,537 | 11/712,540 | 10/854,521 |
| 10/854,522 | 10/854,488 | 10/854,487 | 10/854,503 | 10/854,504 | 10/854,509 | 7,188,928 |
| 7,093,989 | 10/854,497 | 10/854,495 | 10/854,498 | 10/854,511 | 10/854,512 | 10/854,525 |
| 10/854,526 | 10/854,516 | 10/854,508 | 10/854,507 | 10/854,515 | 10/854,506 | 10/854,505 |
| 10/854,493 | 10/854,494 | 10/854,489 | 10/854,490 | 10/854,492 | 10/854,491 | 10/854,528 |
| 10/854,523 | 10/854,527 | 10/854,524 | 10/854,520 | 10/854,514 | 10/854,519 | 10/854,513 |
| 10/854,499 | 10/854,501 | 10/854,500 | 10/854,502 | 10/854,518 | 10/854,517 | 10/934,628 |
| 7,163,345 | 11/499,803 | 11/601,757 | 11/706,295 | 11/735,881 | 11748,483 | 11749,123 |
| 11/014,731 | 11/544,764 | 11/544,765 | 11/544,772 | 11/544,773 | 11/544,774 | 11/544,775 |
| 11/544,776 | 11/544,766 | 11/544,767 | 11/544,771 | 11/544,770 | 11/544,769 | 11/544,777 |
| 11/544,768 | 11/544,763 | 11/293,804 | 11/293,840 | 11/293,803 | 11/293,833 | 11/293,834 |
| 11/293,835 | 11/293,836 | 11/293,837 | 11/293,792 | 11/293,794 | 11/293,839 | 11/293,826 |
| 11/293,829 | 11/293,830 | 11/293,827 | 11/293,828 | 11/293,795 | 11/293,823 | 11/293,824 |
| 11/293,831 | 11/293,815 | 11/293,819 | 11/293,818 | 11/293,817 | 11/293,816 | 11/482,978 |
| 11/640,356 | 11/640,357 | 11/640,358 | 11/640,359 | 11/640,360 | 11/640,355 | 11/679,786 |
| 10/760,254 | 10/760,210 | 10/760,202 | 7,201,468 | 10/760,198 | 10/760,249 | 10/760,263 |
| 10/760,196 | 10/760,247 | 7,156,511 | 10/760,264 | 10/760,244 | 7,097,291 | 10/760,222 |
| 10/760,248 | 7,083,273 | 10/760,192 | 10/760,203 | 10/760,204 | 10/760,205 | 10/760,206 |
| 10/760,267 | 10/760,270 | 7,198,352 | 10/760,271 | 10/760,275 | 7,201,470 | 7,121,655 |
| 10/760,184 | 10/760,195 | 10/760,186 | 10/760,261 | 7,083,272 | 11/501,771 | 11/583,874 |
| 11/650,554 | 11/706,322 | 11/706,968 | 11749,119 | 11/014,764 | 11/014,763 | 11/014,748 |
| 11/014,747 | 11/014,761 | 11/014,760 | 11/014,757 | 11/014,714 | 11/014,713 | 11/014,762 |
| 11/014,724 | 11/014,723 | 11/014,756 | 11/014,736 | 11/014,759 | 11/014,758 | 11/014,725 |
| 11/014,739 | 11/014,738 | 11/014,737 | 11/014,726 | 11/014,745 | 11/014,712 | 11/014,715 |
| 11/014,751 | 11/014,735 | 11/014,734 | 11/014,719 | 11/014,750 | 11/014,749 | 11/014,746 |
| 117586,40 | 11/014,769 | 11/014,729 | 11/014,743 | 11/014,733 | 11/014,754 | 11/014,,755 |
| 11/014,765 | 11/014,766 | 11/014,740 | 11/014,720 | 11/014,753 | 11/014,752 | 11/014,744 |
| 11/014,741 | 11/014,768 | 11/014,767 | 11/014,718 | 11/014,717 | 11/014,716 | 11/014,732 |
| 11/014,742 | 11/097,268 | 11/097,185 | 11/097,184 | 11/293,820 | 11/293,813 | 11/293,822 |
| 11/293,812 | 11/293,821 | 11/293,814 | 11/293,793 | 11/293,842 | 11/293,811 | 11/293,807 |
| 11/293,806 | 11/293,805 | 11/293,810 | 11/688,863 | 11/688,864 | 11/688,865 | 11/688,866 |
| 11/688,867 | 11/688,868 | 11/688,869 | 11/688,871 | 11/688,872 | 11/688,873 | 11/741,766 |
| 11/482,982 | 11/482,983 | 11/482,984 | 11/495,818 | 11/495,819 | 11/677,049 | 11/677,050 |
| 11/677,051 | 11/014,722 | 10/760,180 | 7,111,935 | 10/760,213 | 10/760,219 | 10/760,237 |
| 10/760,221 | 10/760,220 | 7,002,664 | 10/760,252 | 10/760,265 | 7,088,420 | 11/446,233 |
| 11/503,083 | 11/503,081 | 11/516,487 | 11/599,312 | 11/014,728 | 11/014,727 | 10/760,230 |
| 7,168,654 | 7,201,272 | 6,991,098 | 7,217,051 | 6,944,970 | 10/760,215 | 7,108,434 |
| 10/760,257 | 7,210,407 | 7,186,042 | 10/760,266 | 6,920,704 | 7,217,049 | 10/760,214 |
| 10/760,260 | 7,147,102 | 10/760,269 | 10/760,199 | 10/760,241 | 10/962,413 | 10/962,427 |
| 10/962,418 | 10/962,511 | 10/962,402 | 10/962,425 | 10/962,428 | 7,191,978 | 10/962,426 |
| 10/962,409 | 10/962,417 | 10/962,403 | 7,163,287 | 10/962,522 | 10/962,523 | 10/962,524 |
| 10/962,410 | 7,195,412 | 7,207,670 | 11/282,768 | 7,220,072 | 11/474,267 | 11/544,547 |
| 11/585,925 | 11/593,000 | 11/706,298 | 11/706,296 | 11/706,327 | 11/730,760 | 11/730,407 |
| 11/730,787 | 11/735,977 | 11/736,527 | 11/753,566 | 11/754,359 | 11/223,262 | 11/223,018 |
| 11/223,114 | 11/223,022 | 11/223,021 | 11/223,020 | 11/223,019 | 11/014,730 | 7,079,292 |
| 09/575,197 | 7,079,712 | 09/575,123 | 6,825,945 | 09/575,165 | 6,813,039 | 6,987,506 |
| 7,038,797 | 6,980,318 | 6,816,274 | 7,102,772 | 09/575,186 | 6,681,045 | 6,728,000 |
| 7,173,722 | 7,088,459 | 09/575181 | 7,068,382 | 7,062,651 | 6,789,194 | 6,789,191 |
| 6,644,642 | 6,502,614 | 6,622,999 | 6,669,385 | 6,549,935 | 6,987,573 | 6,727,996 |
| 6,591,884 | 6,439,706 | 6,760,119 | 09/575,198 | 6,290,349 | 6,428,155 | 6,785,016 |
| 6,870,966 | 6,822,639 | 6,737,591 | 7,055,739 | 09/575,129 | 6,830,196 | 6,832,717 |
| 6,957,768 | 09/575172 | 7,170,499 | 7,106,888 | 7,123,239 | | |

BACKGROUND OF THE INVENTION

The present invention involves the ejection of ink drops by way of forming gas or vapor bubbles in a bubble forming liquid. This principle is generally described in U.S. Pat. No. 3,747,120 to Stemme.

There are various known types of thermal inkjet (Bubblejet™ is owned by Canon K.K.) printhead devices. Two typical devices of this type, one made by Hewlett Packard and the other by Canon, have ink ejection nozzles and chambers for storing ink adjacent the nozzles. Each chamber is covered by a so-called nozzle plate which is mechanically secured to the walls of the chamber. These devices also include heater elements in thermal contact with ink that is disposed adjacent the nozzles, for heating the ink thereby forming gas bubbles in the ink. The gas bubbles generate pressures in the ink causing ink drops to be ejected through the nozzles.

Thermal inkjet printheads are traditionally prone to overheating. The rapid successive vaporization of ink during printing can build up heat in the printhead. If too much builds up in the printhead, the ink will boil in an uncontrolled manner. This heat is removed from the printhead either by an active cooling system or with heats sinks and the use of small nozzle arrays. The overheating problem has limited the firing frequency of the nozzles and printhead size, both of which reduce the print speed.

The Applicant has developed a range of pagewidth printheads that overcome the problem of excess heat generation. The large pagewidth arrays and high nozzle firing frequencies provide print speeds in excess of 60 pages per minute at full color 1600 dpi resolution. These printheads avoid excess heat generation by reducing the energy used by the heaters to eject the drops of ink. The heat input to the printhead by the heaters is removed from the printhead by the ejected drops of ink.

One aspect of reducing the energy required to eject drops of ink is a reduction in the mass of the ejected drop, and hence the volume of the drop. The Applicant's 'self cooling' printheads eject drops of about 1 pl to 2 pl (pico-liters). Unfortunately drop volumes this small are susceptible to trajectory misdirection. The trajectory of the ejected drop is particularly sensitive to the nozzle geometry and the shape of the bubble generated by the heater element. It will be appreciated that any misdirection of the ejected ink drops is detrimental to print quality.

Fluidic symmetry around the heater is not possible unless the heater is suspended directly over the ink inlet. The Applicant has developed printheads with this arrangement (see U.S. Pat. No. 6,755,509 filed Nov. 23, 2002), however there are production efficiencies and nozzle density gains available if multiple ink chambers are supplied from a single ink supply channel through the supporting wafer. This requires that the individual chambers are supplied with ink through lateral inlets—that is, inlets extending parallel to the planes of the heaters and the nozzles. As the heater is laterally bounded by the chamber walls except for the ink inlet, the bubble generated by the heater is distorted by this asymmetry. The inlet can be lengthened and or narrowed to increase its fluidic resistance to back flow caused by the bubble. This will reduce the fluidic asymmetry caused by the inlet but also increase the chamber refill times because of the higher flow resistance.

SUMMARY OF THE INVENTION

Accordingly, the present invention provides a printhead for an inkjet printer, the printhead comprising:

An array of nozzles each defining a planar ejection aperture;

a plurality heater elements corresponding to each of the nozzles respectively, each heater element formed as a planar structure, the heater element having opposing sides positioned parallel to the plane of the ejection aperture, the opposing sides defining a two dimensional shape with two orthogonal axes of symmetry and during use the heater element generates a vapor bubble that is asymmetrical about at least one of the axes of symmetry; wherein, the ejection aperture has a centroid that is offset from the centroid of the two dimensional shape of the heater element in a direction parallel to the plane of the ejection aperture.

The invention is predicated on the realization that misdirected drop trajectories caused by asymmetries in the vapor bubble can be compensated for by offsetting the nozzle centroid from the heater centroid. The ordinary worker in this field will understand that the centroid is a point at the geometric centre of a two dimensional shape.

The vapor bubble generated by the heater can be asymmetrical because of the configuration of the heater relative to the nozzle and the ink inlet. As the bubble grows, it not only forces ink from the nozzle but also creates a small back flow of ink through the ink inlet. The back flow is usually negligible compared to the ink ejected because the fluidic drag resisting flow out of the inlet compared to flow out of the nozzle is very high. If the ink inlet is at the side of the chamber (that is, the inlet flow is parallel to the plane of the heater and the nozzle), the small back flow of ink allows the bubble to skew towards the ink inlet. The pressure pulse through the ink is likewise skewed and meets one side of the ejection aperture slightly before the other side.

The ink drop ejected through the nozzle will trail a thin stem of ink behind it immediately after ejection. Eventually the momentum of the drop overcomes the surface tension in the trailing stem of ink to break the stem so that the drop completely separates from the printhead. With a skewed pressure pulse ejecting the drop, the trailing stem of ink pins to one particular side or part of the ejection aperture. Before the thin stem of ink between the nozzle and the ejected drop breaks, the surface tension in the stem can drag the droplet away from a trajectory normal to the plane of the nozzles. This causes consistent droplet misdirection. However, the invention addresses this by offsetting the heater and nozzle from each other so that the pressure pulse is much less skewed when it is incident on the nozzle aperture.

Preferably, the printhead further comprising a plurality of chambers in fluid communication with each of the nozzles respectively, each of the chambers adapted to hold printing fluid in contact with each of the heater elements respectively, wherein the chamber has a printing fluid inlet that defines a fluid path that extends parallel to the plane of the heater element. In a further preferred form, the chambers defines walls extending generally transverse to the plane of the heater element, the walls surrounding the heater element except for an opening defining one end of the printing fluid inlet. In a particularly preferred form, the ejection aperture centroid is offset from the centroid of the two dimensional shape of the heater element in a direction away from the printing fluid inlet.

Optionally, the ejection aperture is elliptical. In another option, the heater element is a rectangular beam. In some embodiments, the major axis of the elliptical ejection aperture is parallel to the longitudinal extent of the rectangular beam heater element.

Preferably, the heater element is a rectangular beam suspended in the chamber. In a further preferred form, the vapor bubble vents to atmosphere through the ejection aperture.

Preferably, the ejection aperture centroid is offset from the centroid of the two dimensional shape of the heater element in a direction parallel to the major axis of the ejection aperture.

Preferably, the nozzle is formed in a roof layer that partially defines the chamber, and the roof layer and the walls of the chamber are integrally formed.

In some embodiments, the heater element is a rectangular beam and the chamber is less than 40 microns wide in a direction transverse to the rectangular beam, and less than 80 microns long in the elongate direction of the rectangular beam. In these embodiments, it is preferable when the vapor bubble ejects a drop of printing fluid through the ejection aperture, the drop having a volume between 1 pl and 2 pl.

Preferably the offset is less than 20 microns. In a further preferred form, the offset is less than 5 microns. In a particularly preferred form, the offset is between 1 micron and 3 microns.

BRIEF DESCRIPTION OF THE DRAWINGS

Preferred embodiments of the present invention will now be described by way of example only with reference to the accompanying drawings in which.

DETAILED DESCRIPTION OF THE PREFERRED EMBODIMENTS

FIGS. 1 to 5 sketch the ejection stages of a misdirected drop of ink from a prior art printhead. The printhead structure is a simplified representation of the printheads described in detail in U.S. Ser. No. 11/246,687 filed Oct. 11, 2005, the contents of which are incorporated herein by reference. While the invention is described here with reference to this particular printhead design, it will be appreciated that this is purely illustrative and in no way restrictive on the printheads to which the invention can be applied.

Figure 1:
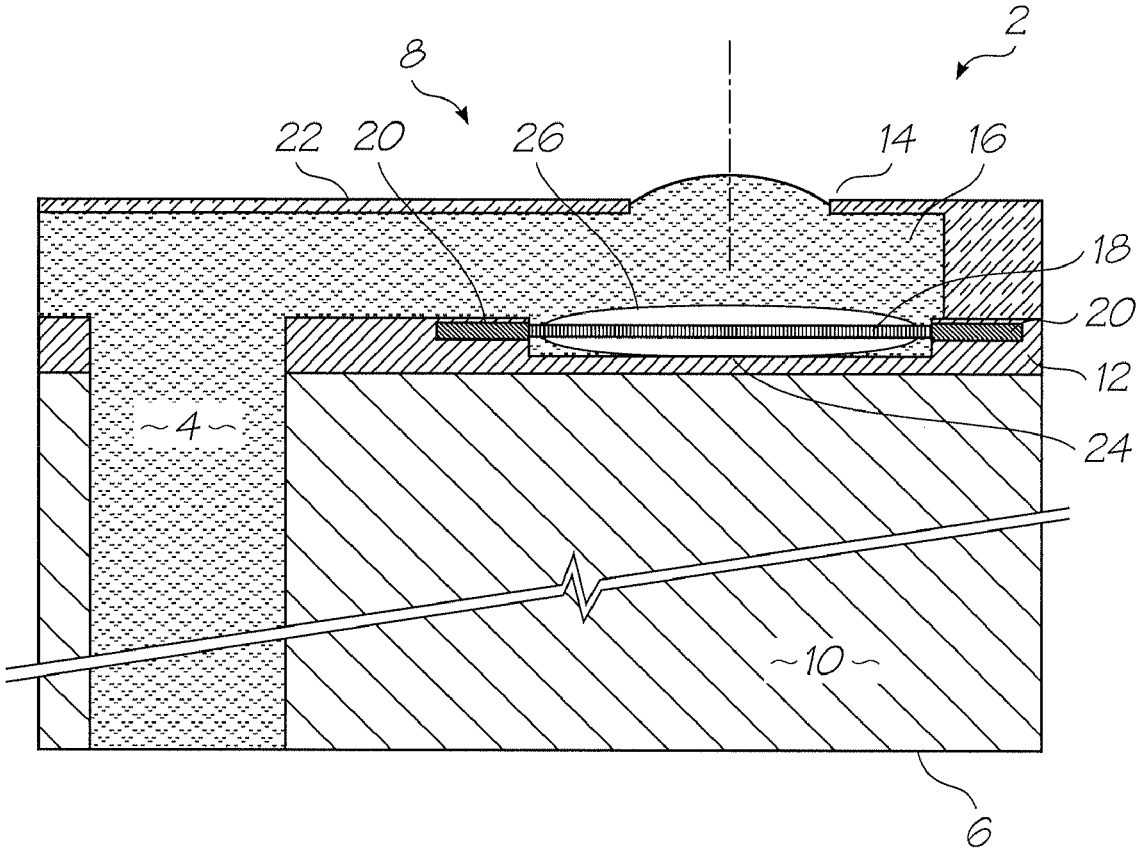
FIG. 1 (PRIOR ART)
FIGS. 1 to 5 schematically shows the ejection of a drop of ink from a prior art printhead without any offset between the nozzle and the heater.

Referring to FIG. 1, a unit cell of an inkjet printhead 2 is shown. The unit cell is the smallest repeatable unit making up the printhead—in this case the ink supply channel 4 extending from the supply side 6 of the wafer substrate 10, to the ejection side 8 of the wafer substrate, the nozzle 14, the chamber 16, the suspended beam heater 18 with its contacts 20 and associated CMOS drive circuitry 12.

The heater 18 is a thin rectangular strip suspended as a beam over a trench 24 in the floor of the chamber 16. The centroid of the top surface rectangle shape of the heater 18 is simply the intersection of the rectangle's diagonals. The nozzle 14 is an ellipse so the centroid is simply the intersection of the major and minor axes. As described in the above referenced U.S. Ser. No. 11/246,687 filed Oct. 11, 2005 the roof layer 22 is formed by CVD of silicon nitride and the nozzles 14 subsequently etched. Hence the centroids of the nozzle and the heater are closely aligned.

Figure 2:
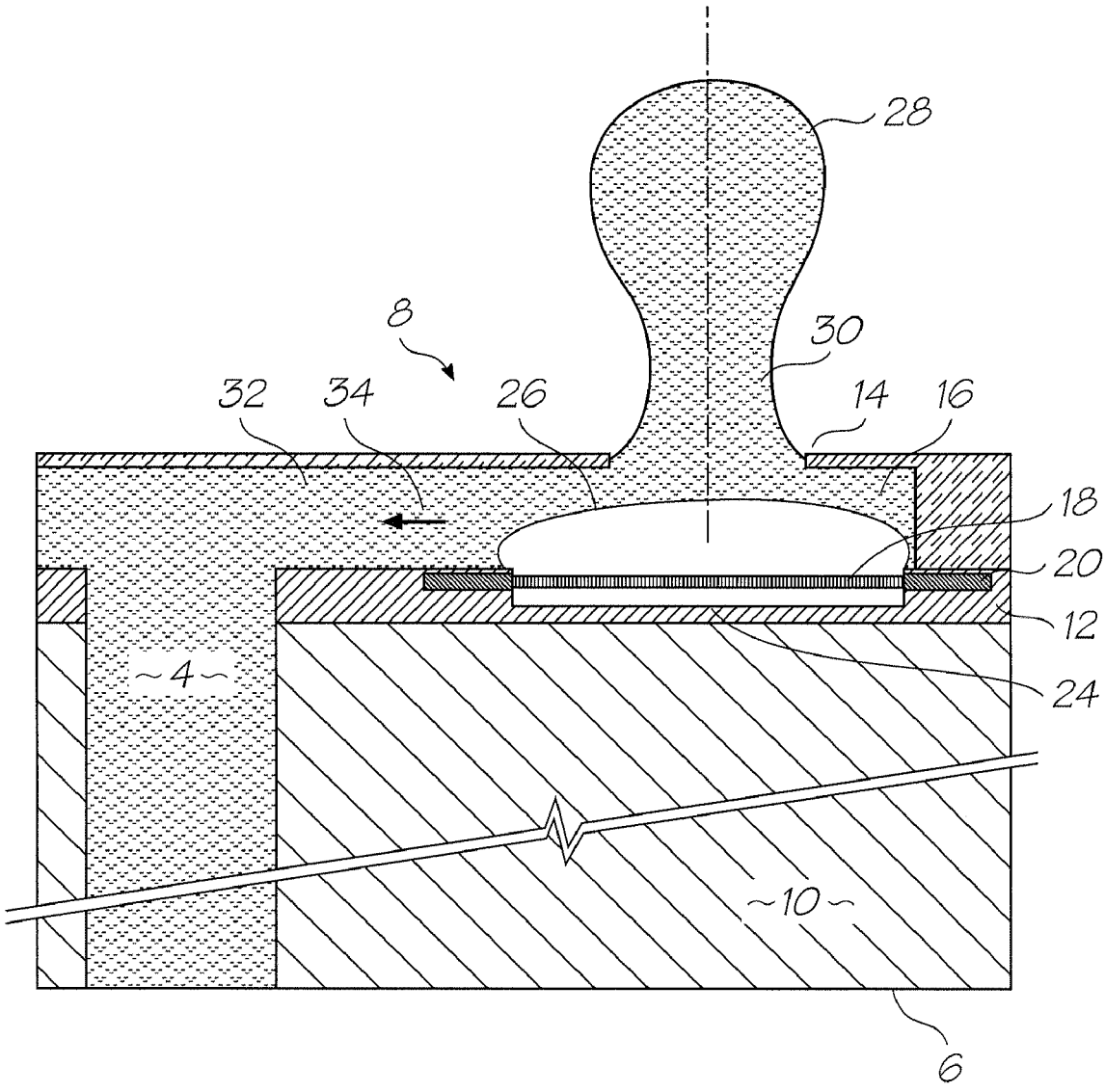
FIG. 2 (PRIOR ART)

FIG. 1 shows the nucleation of the vapor bubble 26 around the heater 18. It begins with film boiling of the ink directly in contact with the heater surface. In FIG. 2, the vapor bubble 26 has grown and has forced a bulb of ink 28 through the nozzle 14. A stem 30 of ink trails behind the bulb 28 and pins to the edges of the nozzle 14. The pressure pulse in the chamber 16 also causes a small backflow 34 of ink through the chamber inlet 32.

Figure 3:
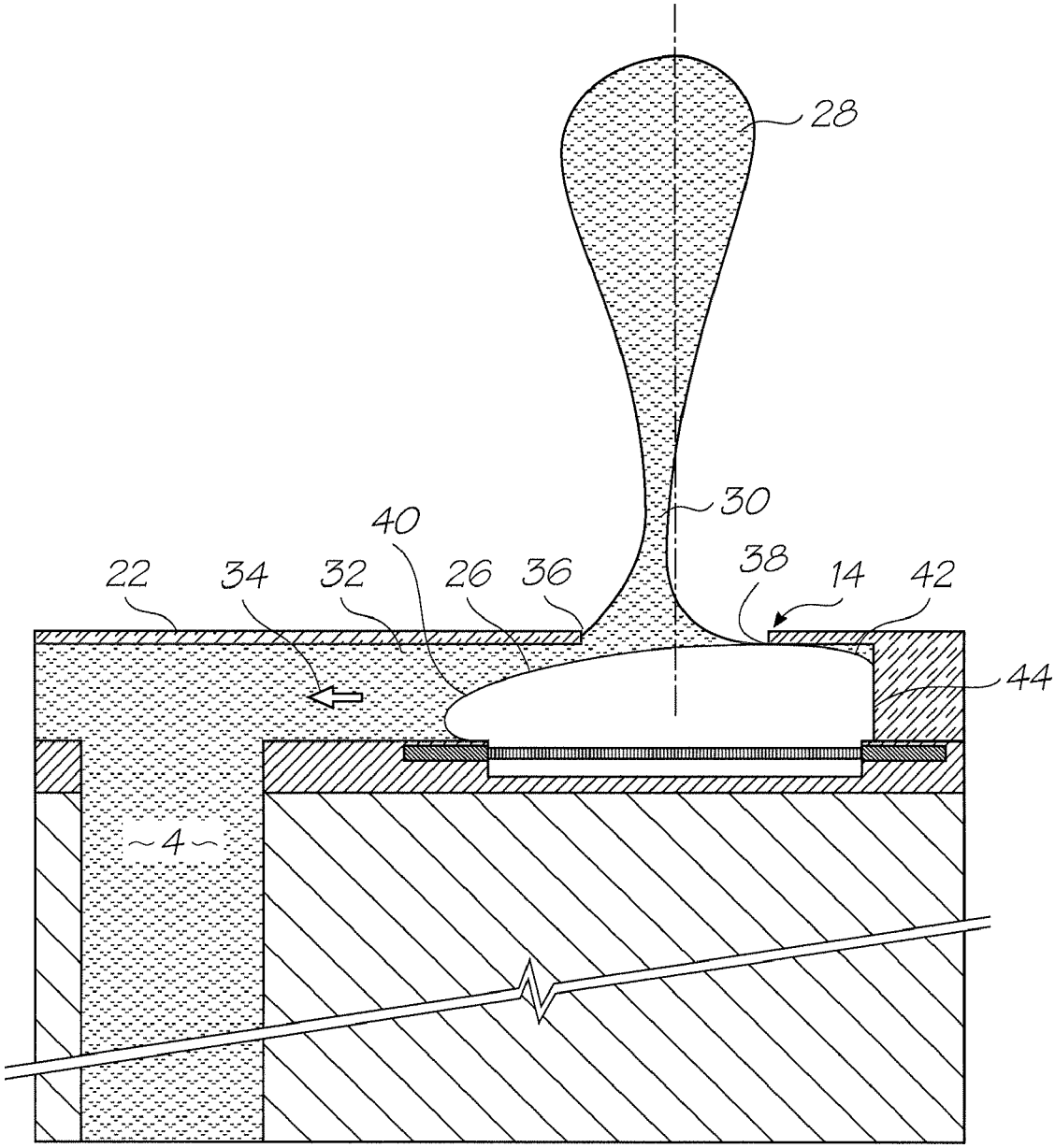
FIG. 3 (PRIOR ART)

FIG. 3 shows the bubble 26 immediately before it vents to atmosphere through the nozzle 14. The ejected drop 28 is still connected to the ink in the chamber by the thin stem of ink 30. The backflow 34 of ink through the chamber inlet 32 has allowed the bubble 26 to widen and flatten on the inlet side 40, while the side 42 constrained by the chamber walls 44 has grown to the roof layer 22 and one side 38 of the nozzle 14. The bubble surface 40 is still spaced from the opposing side 38 of the nozzle 14.

Figure 4:
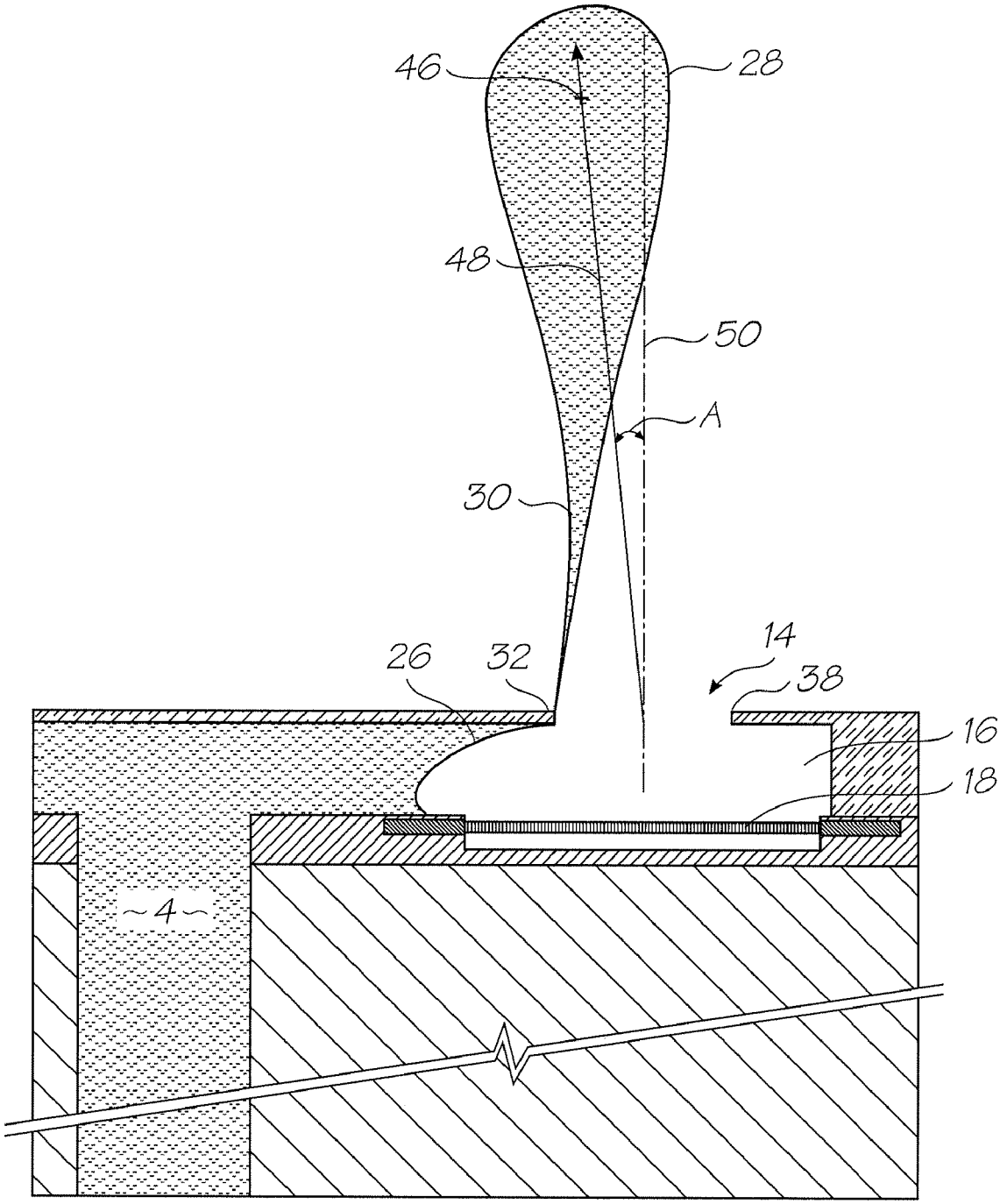
FIG. 4 (PRIOR ART)

In FIG. 4, the thin stem of ink 30 is shown immediately before the momentum of the ejected drop 28 overcomes the surface tension of the ink and breaks the connection to the side 32 of the nozzle 14. The bubble 26 has vented to atmosphere through the nozzle 14. However, as the bubble is always first incident on the nozzle aperture at the side 38, the stem 30 invariably pins to the side 32.

The side 32 is spaced from the centre line 50 of the nozzle 14. The surface tension acting on the stem has a component acting normal to the centre line 50. As a result, the centre of mass 46 of the drop 28 is pulled away from the centre line 50 until the stem 30 breaks. The drop trajectory 48 now deviates from the centre line 50 by the angle A.

Figure 5:
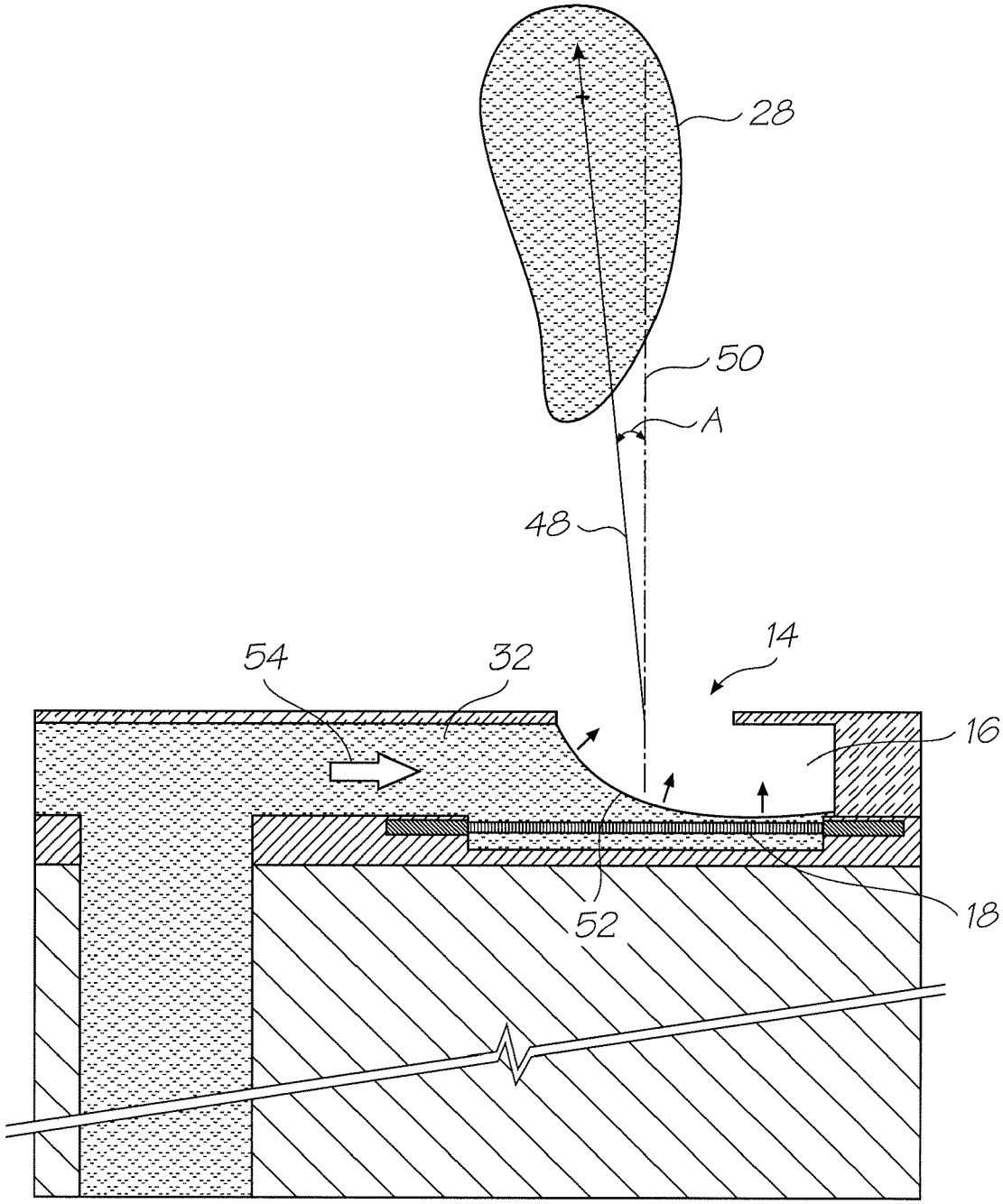
FIG. 5 (PRIOR ART)

FIG. 5 shows the now separated drop 28 continuing along it's deviated trajectory 48. The bubble has become an ink meniscus 52 in the chamber 16 rapidly shrinking toward the nozzle 14 under the action of surface tension. This draws a refill flow 54 of ink through the inlet 32 and the process repeats when the heater 18 is next actuated.

Figure 6:
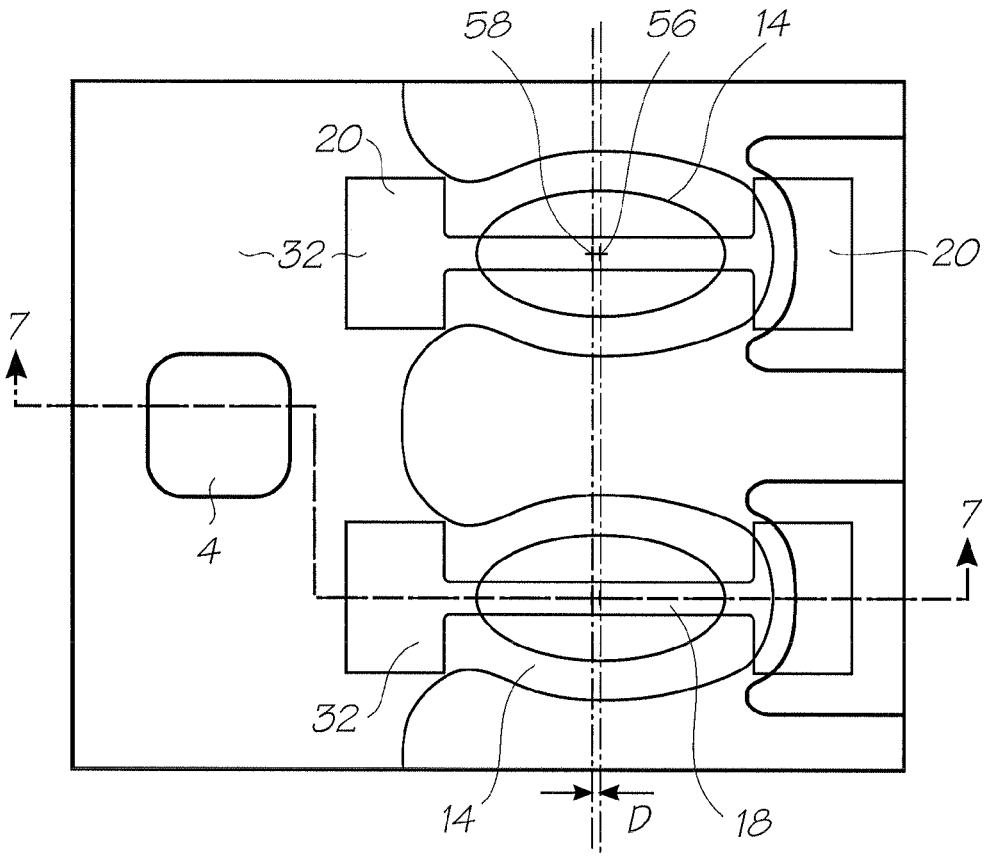
FIG. 6 is a partial plan view of a printhead with offset heater and nozzle.
Figure 7:
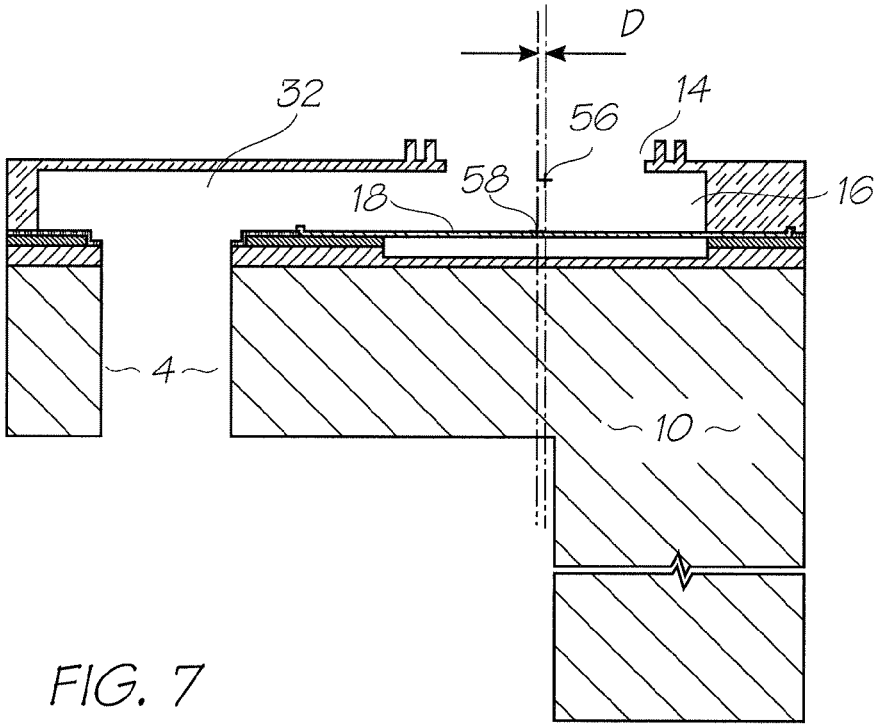
FIG. 7 is a partial section view taken along line 7-7 of FIG. 6; and, FIGS. 8 to 13 schematically shows the ejection of a drop of ink from a printhead with the nozzle and the heater offset from each other.

The invention takes the asymmetry of the bubble into account and offsets the heater and nozzle accordingly. FIGS. 6 and 7 show this arrangement. The plan view shown in FIG. 6, the nozzle aperture centroid 56 is slightly offset from the heater centroid 58 by a distance D. The offset D of the nozzle 14 is away from the chamber inlet 32 to counter the bubble asymmetry caused by ink back flow.

As seen in FIG. 7, the spacing between the plane of the heater and the plane of the nozzle is not the relevant offset—only the displacement of the heater centroid 58 relative to the nozzle centroid 56 in the plane of the nozzle aperture 14. It will also be appreciated that centroid of the heater is a reference to the entire heater element structure. It may be the case that the heater has several parallel beams extending between the electrodes 20. The bubbles generated by each individual beam will coalesce into a single bubble that ejects the ink from the nozzle. Accordingly, the nozzle centroid 56 is to be offset from a centroid of the overall two dimensional shape of the heater element(s) that generate the coalesced bubble.

Figure 8:
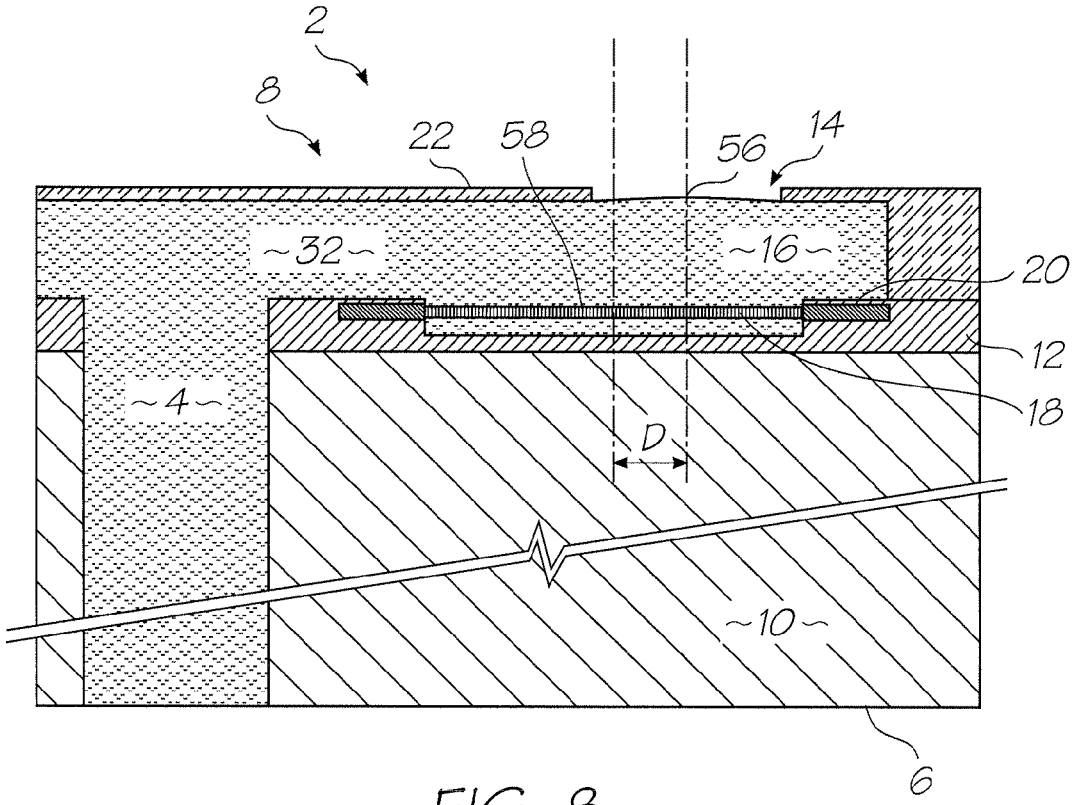

FIG. 8 to 13 schematically illustrates the drop ejection process using a printhead according to the present invention. FIG. 8 shows the unit cell 2 in the quiescent state. The chamber 16 is primed with ink which completely immerses the heater 18. The heater 18 is powered by contacts 20 in the CMOS drive circuitry 12. The CMOS 12 is supported on the underlying silicon wafer 10. The ink supply channel 4 fluidically connects the supply side 6 and the ejection side 8 of the printhead IC. Ink flows to the individual chamber 16 via the inlets 32. The nozzles 14 are etched into the roof layer 22 such that the heater centroid 58 is offset from the nozzle centroid 56 by a distance D in the plane of the nozzle aperture.

Figure 9:
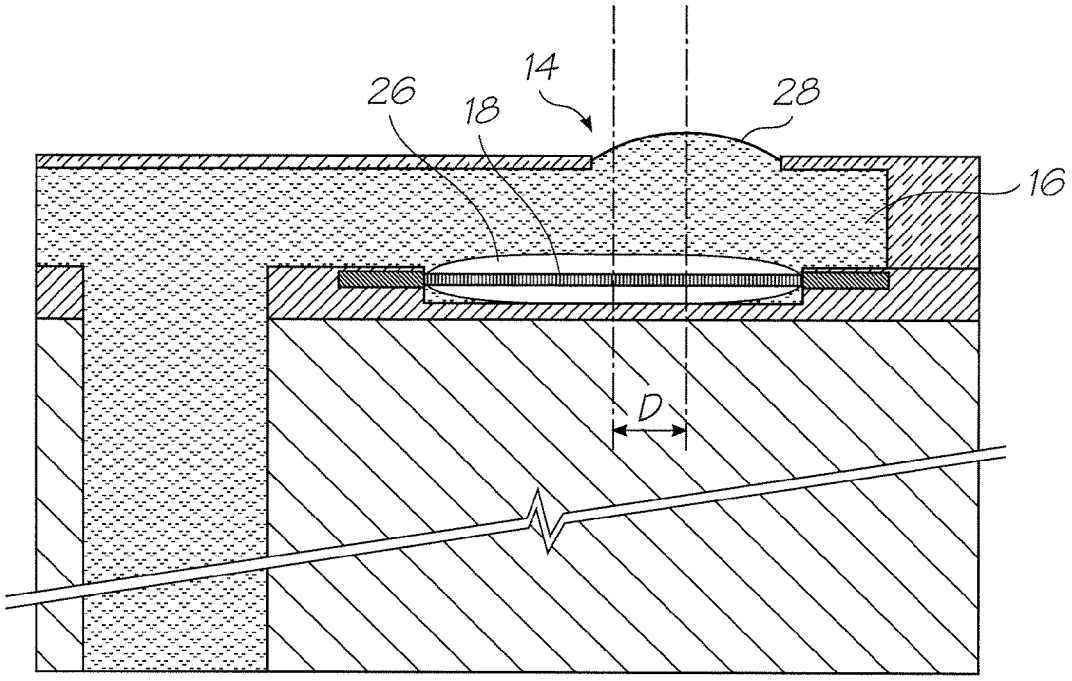
Figure 10:
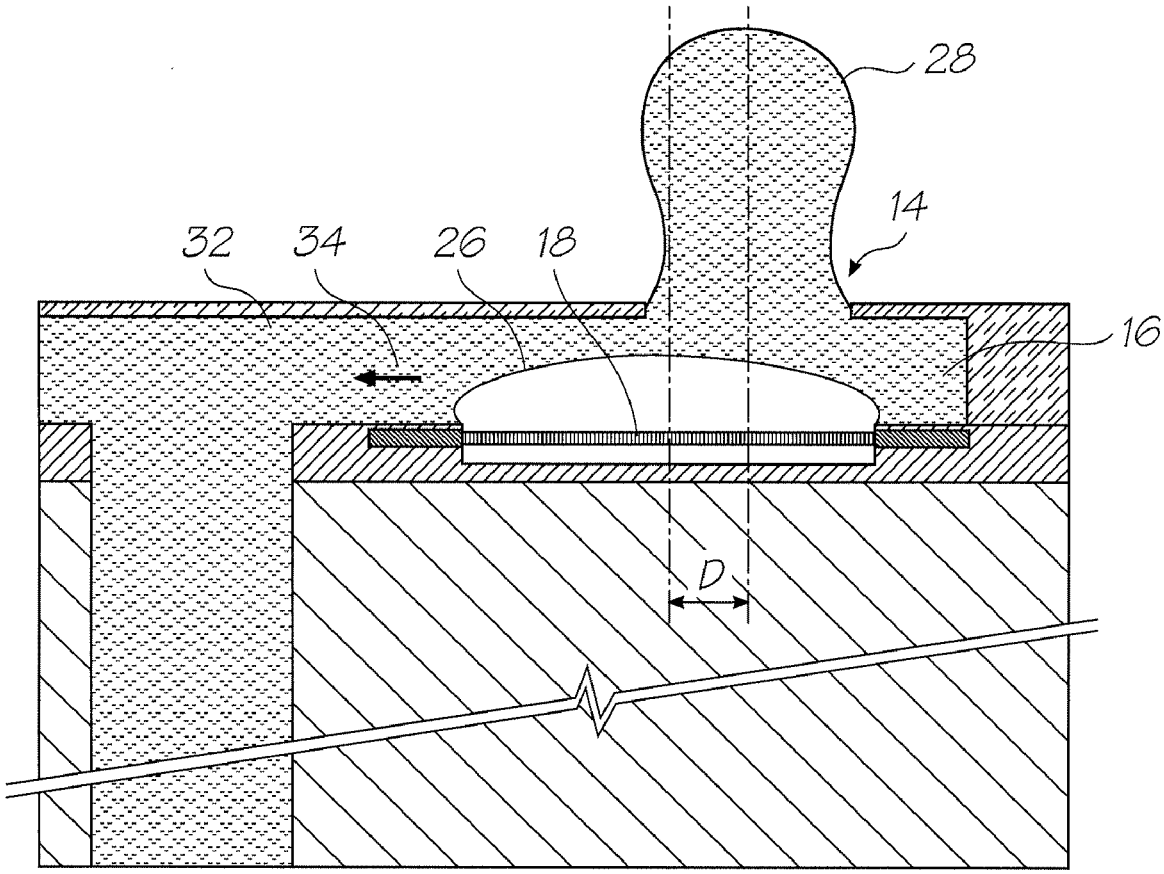
Figure 11:
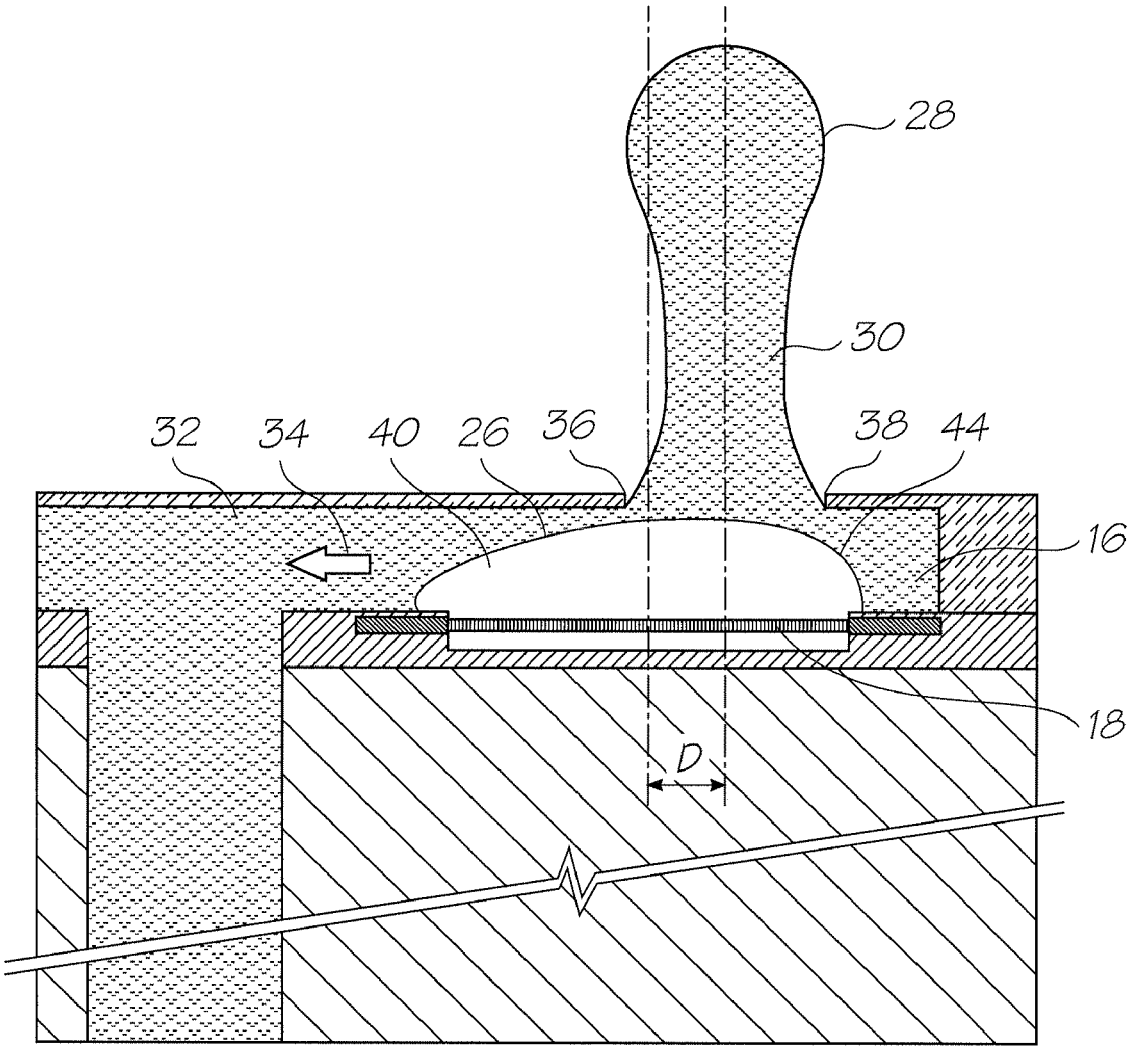

In FIG. 9, the heater 18 has received a drive pulse and film boiling at the heater surface nucleates the bubble 26. The increased pressure in the chamber forces the ink meniscus at the nozzle 14 to bulge outwardly and begin forming the drop 28. In FIG. 10, the bubble 26 grows and forces more ink from the chamber 16 out of the nozzle 16. It also starts a small back flow 34 in the inlet 32. As the bubble 26 expands further (see FIG. 11) the side 40 facing the inlet 32 is unconstrained and has a flatter, broader profile. In contrast, the side 44 facing the away from the inlet 32 is constrained so the bubble has a taller profile on this side. However, as the nozzle 14 is offset away from the inlet 32 by the distance D, the bubble 26 is approximately the same distance from the nozzle edge 36 as it is from the nozzle edge 38.

Figure 12:
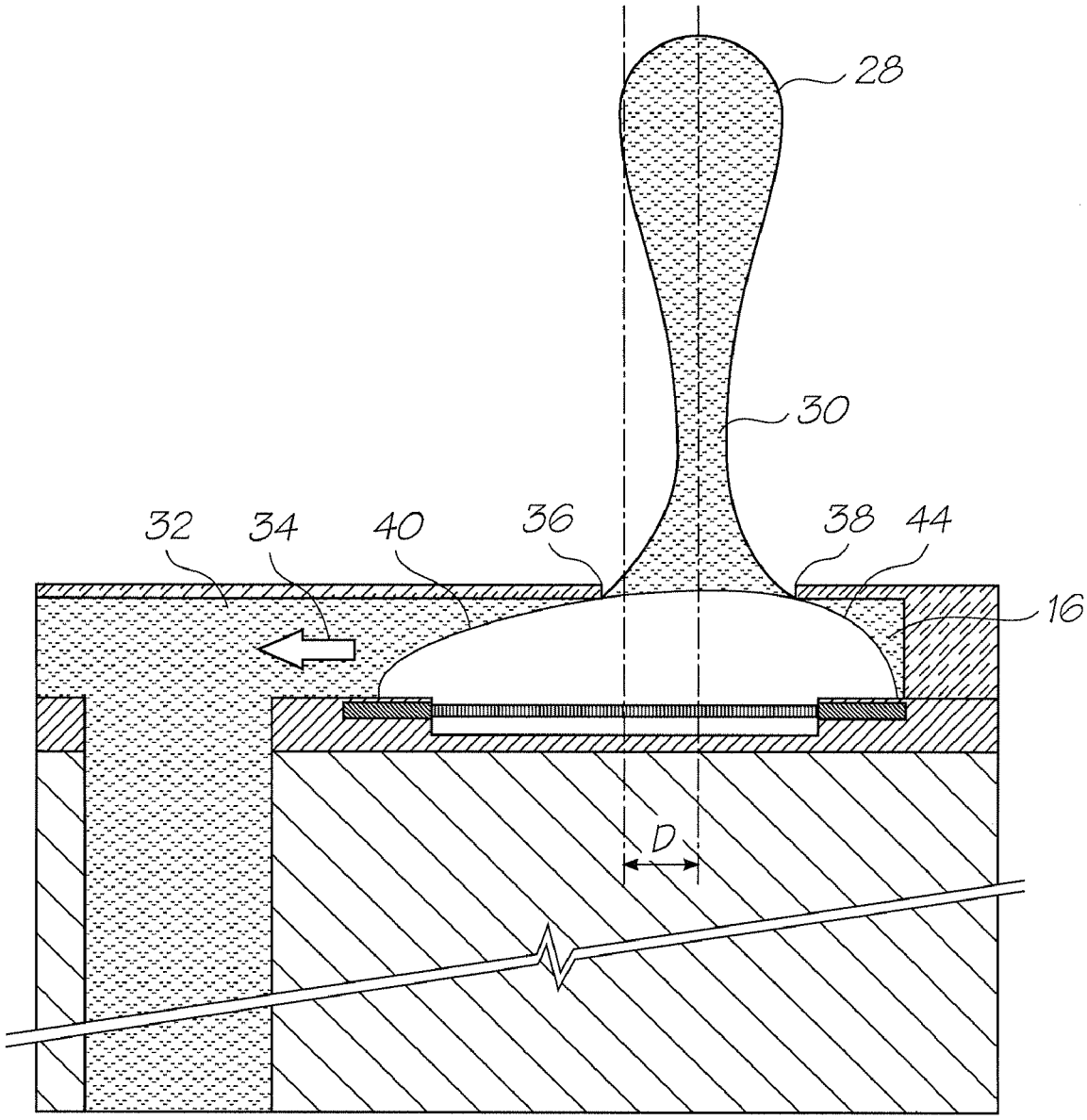
Figure 13:
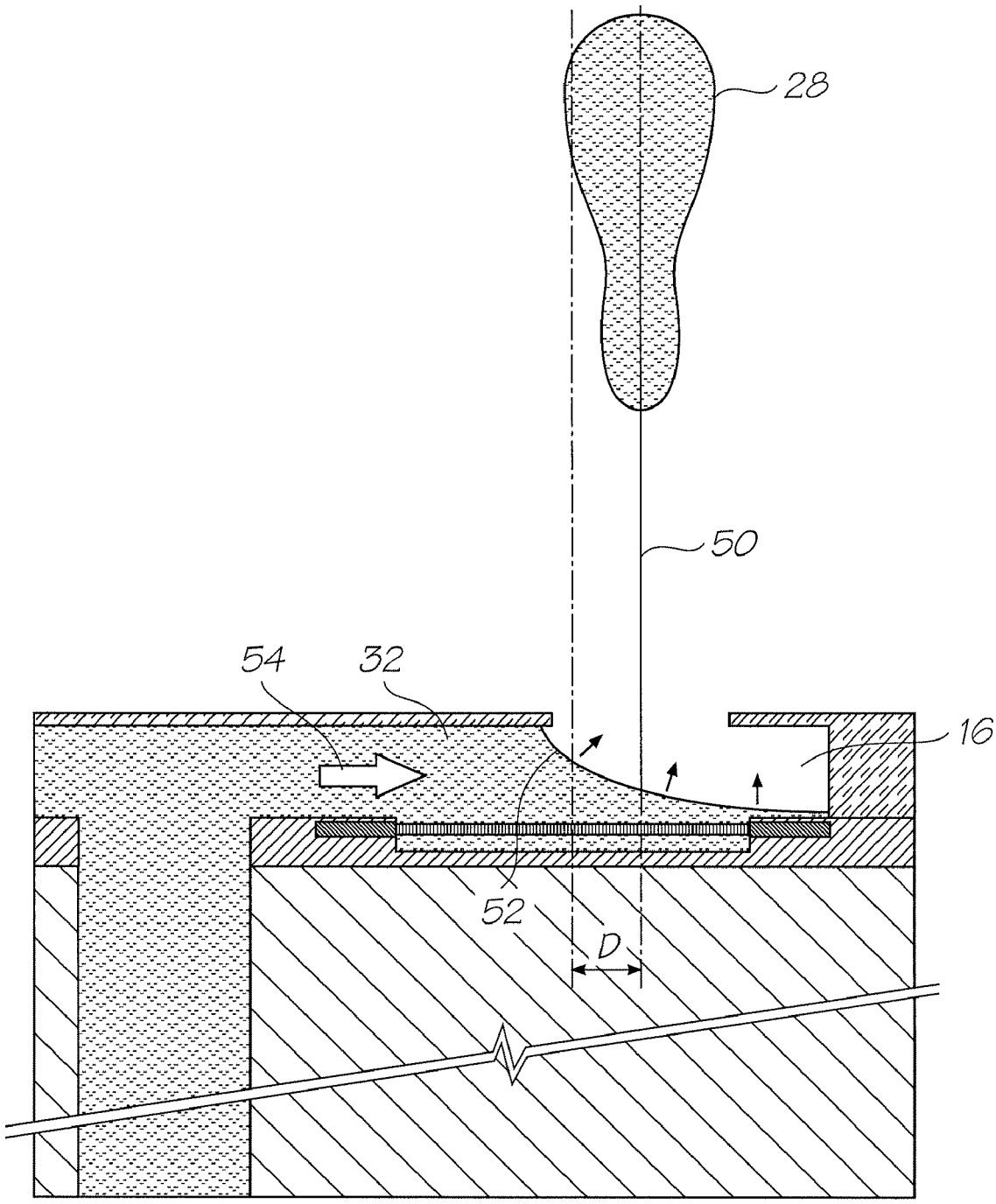

If the printhead is of the type that vents the bubble 26 through the nozzle to avoid the cavitation corrosion of a bubble collapse point, the bubble will ideally contact all points on the nozzle's periphery simultaneously. This is shown in FIG. 12. As the bubble 26 touches the edge 36 and the edge 38 at the same time so the stem 30 trailing the drop 28 is not induced to pin itself at one specific location on the nozzle periphery. Consequently, as shown in FIG. 13, when the stem 3 breaks and the drop 28 separates, it has not been dragged away from the centroidal axis 50 of the nozzle by surface tension in the ink. The ejection trajectory stays on the centroidal axis of the nozzle 14.

Also shown in FIG. 13, the vented bubble becomes an ink meniscus 52 within the chamber 16. Surface tension drives the meniscus to the smallest surface area possible so it rapidly contracts to span the nozzle aperture 14. This draws the refill flow 54 of ink through the inlet 32.

The magnitude of nozzle offset will depend on a large number of variables such as chamber configuration, the dimensions of the heater, nozzle, and roof layer height and the nozzle shape. However, in most cases the offset need only be relatively small. For example, the unit cell of the printhead described in the above referenced U.S. Ser. No. 11/246,687 filed Oct. 11, 2005, has chambers of 32 microns wide and less than 80 microns from the ink supply channel to outside of the chamber end wall (opposite the inlet). In these printheads, offsetting the nozzle centroid from the heater centroid by less than 5 microns was sufficient to address instances of drop misdirection. As these printhead unit cells are particularly small relative to other prior art printhead unit cells, the maximum offset necessary for the vast majority of so called 'roof-shooter' printheads would be 20 microns. In the Applicant's range of printheads, most offsets would be between 1 and 3 microns.

The present invention has been defined herein by way of example only. The skilled addressee would readily recognize many variations and modifications which do not depart from the spirit ad scope of the broad invention concept.

The invention claimed is:

1. A printhead for an inkjet printer, the printhead comprising:

an array of nozzles each defining a planar ejection aperture;

a plurality heater elements corresponding to each of the nozzles respectively, each heater element formed as a planar structure, the heater element having opposing sides positioned parallel to the plane of the ejection aperture, the opposing sides defining a two dimensional shape with two orthogonal axes of symmetry and during use the heater element generates a vapor bubble that is asymmetrical about at least one of the axes of symmetry; wherein, the ejection aperture has a centroid that is offset from the centroid of the two dimensional shape of the heater element in a direction parallel to the plane of the ejection aperture.

2. A printhead according to claim 1 further comprising a plurality of chambers in fluid communication with each of the nozzles respectively, each of the chambers adapted to hold printing fluid in contact with each of the heater elements respectively, wherein the chamber has a printing fluid inlet that defines a fluid path that extends parallel to the plane of the heater element.

3. A printhead according to claim 2 wherein the chambers defines walls extending generally transverse to the plane of the heater element, the walls surrounding the heater element except for an opening defining one end of the printing fluid inlet.

4. A printhead according to claim 3 wherein the ejection aperture centroid is offset from the centroid of the two dimensional shape of the heater element in a direction away from the printing fluid inlet.

5. A printhead according to claim 4 wherein the nozzle is formed in a roof layer that partially defines the chamber, and the roof layer and the walls of the chamber are integrally formed.

6. A printhead according to claim 5 wherein the heater element is a rectangular beam and the chamber is less than 40 microns wide in a direction transverse to the rectangular beam, and less than 80 microns long in the elongate direction of the rectangular beam.

7. A printhead according to claim 6 wherein during use the vapor bubble ejects a drop of printing fluid through the ejection aperture, the drop having a volume between 1 pl and 2 pl.

8. A printhead according to claim 2 wherein the heater element is a rectangular beam suspended in the chamber.

9. A printhead according to claim 5 wherein the offset is less than 20 microns.

10. A printhead according to claim 9 wherein the offset is less than 5 microns.

11. A printhead according to claim 10 wherein the offset is between 1 micron and 3 microns.

12. A printhead according to claim 1 wherein the ejection aperture is elliptical.

13. A printhead according to claim 12 wherein the heater element is a rectangular beam.

14. A printhead according to claim 13 wherein the major axis of the ejection aperture is parallel to the longitudinal extent of the heater element.

15. A printhead according to claim 14 wherein the ejection aperture centroid is offset from the centroid of the two dimensional shape of the heater element in a direction parallel to the major axis of the ejection aperture.

16. A printhead according to claim 1 wherein during use the vapor bubble vents to atmosphere through the ejection aperture.

* * * * *